US011008132B1

(12) United States Patent
Mahler et al.

(10) Patent No.: US 11,008,132 B1
(45) Date of Patent: May 18, 2021

(54) PACKAGING FOR SHOES

(71) Applicant: Amazon Technologies, Inc., Seattle, WA (US)

(72) Inventors: Justine Lea Mahler, Seattle, WA (US); Mike Custer, St. Charles, IL (US); Chad Hockin, Seattle, WA (US); Alexander Kent, Seattle, WA (US); Brent Lindberg, St. Charles, IL (US); Jenna Walsh, St. Charles, IL (US)

( * ) Notice: Subject to any disclaimer, the term of this patent is extended or adjusted under 35 U.S.C. 154(b) by 493 days.

(21) Appl. No.: 15/610,554

(22) Filed: May 31, 2017

(51) Int. Cl.

| | |
|---|---|
| ***B65D 5/02*** | (2006.01) |
| ***B65D 5/42*** | (2006.01) |
| ***B65D 5/66*** | (2006.01) |
| ***B65D 5/54*** | (2006.01) |
| ***B65D 85/18*** | (2006.01) |
| ***A47F 7/08*** | (2006.01) |

(52) U.S. Cl.
CPC ..... *B65D 5/0254* (2013.01); *A47F 7/08* (2013.01); *B65D 5/4233* (2013.01); *B65D 5/4266* (2013.01); *B65D 5/541* (2013.01); *B65D 5/6602* (2013.01); *B65D 85/187* (2013.01)

(58) Field of Classification Search
USPC ..... 206/45.23, 45.25, 45.21, 736, 45.24
See application file for complete search history.

(56) References Cited

U.S. PATENT DOCUMENTS

| | | | | |
|---|---|---|---|---|
| 1,125,987 | A * | 1/1915 | Eichhorn | B65D 5/5206 206/45.21 |
| 1,418,798 | A * | 6/1922 | Hirschl | B65D 5/5206 206/45.21 |
| 2,248,547 | A * | 7/1941 | Osteen | B65D 5/5206 206/45.21 |
| 4,592,464 | A * | 6/1986 | Londagin | B65D 5/524 206/45.28 |
| 5,325,960 | A * | 7/1994 | Sims | B65D 5/4204 206/301 |
| 9,440,763 | B1 * | 9/2016 | Einstein | B65D 5/5038 |
| 2008/0087556 | A1 * | 4/2008 | Henke | B65D 5/5213 206/45.23 |
| 2010/0282831 | A1 * | 11/2010 | Fithian | B65D 5/321 229/238 |
| 2016/0318652 | A1 * | 11/2016 | Torbert | B65D 5/5206 |
| 2016/0318653 | A1 * | 11/2016 | Pfeifer | B65D 5/5038 |
| 2017/0275046 | A1 * | 9/2017 | Manella | B65D 5/52 |

* cited by examiner

*Primary Examiner* — J. Gregory Pickett
*Assistant Examiner* — Tia Cox
(74) *Attorney, Agent, or Firm* — BakerHostetler

(57) ABSTRACT

A single piece of material that changes from a cuboid to a wedge includes a central panel bounded by four creases and four sidewall panels extending therefrom, respectively. A fold-over panel extends from the second sidewall panel. The third and fourth sidewall panels each define first and second portions sharing a crease angled from the respective third or fourth crease. The central panel, fold-over panel, and sidewall panels define the top, bottom, and sides of the cuboid, respectively, with an interior label. In the wedge: the second sidewall panel and the first portions extend downward from the central panel, the second portions are folded inward from the first portions, the central panel overlies and is inclined at the angle with respect to the fold-over panel, which is attached to the first sidewall panel, and the label is exterior. Each crease is pre-formed in the piece.

14 Claims, 5 Drawing Sheets

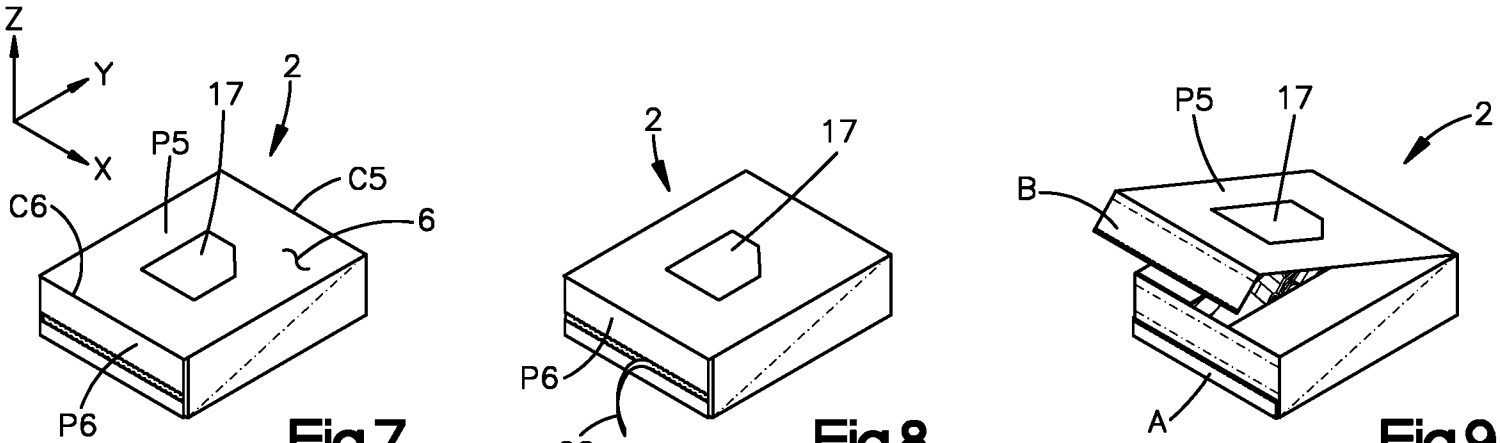
Fig.7
Fig.8
Fig.9
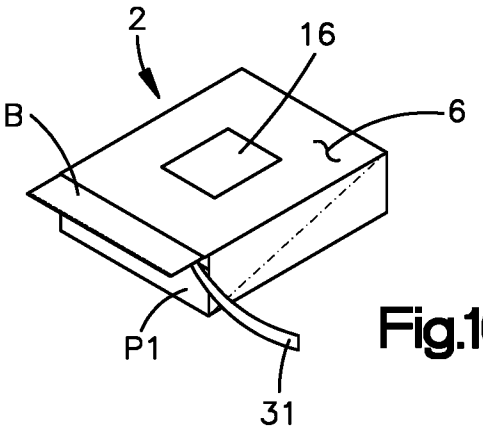
Fig.10
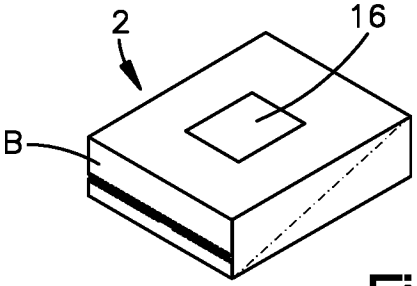
Fig.11

PACKAGING FOR SHOES

BACKGROUND

In material handling facilities, such as order fulfillment centers, retail items may arrive at the fulfillment center already packaged in a container that is not satisfactory for shipping. In these instances, the first container may be placed into a second outer container, such as a corrugated fiberboard box, that is satisfactory for shipping. The second outer container bears the shipping label. By initially placing the shoes in a Ship in Own Container ("SIOC") capable package prior to delivery to the fulfillment center, the need for the second outer container is eliminated.

BRIEF DESCRIPTION OF THE DRAWINGS

The following detailed description will be better understood when read in conjunction with the appended drawings, in which there is shown in the drawings example embodiments for the purposes of illustration. It should be understood, however, that the present disclosure is not limited to the precise arrangements and instrumentalities shown. Rather, the drawings and the corresponding text merely describe embodiments of the invention, and are not intended to limit the scope of the claims. In the drawings:

FIG. 7 shows a perspective view of the container of FIG. 1, wherein the container is folded to a fully enclosed, sealed configuration that is ready for shipping;

FIG. 8 shows a perspective view of the container of FIG. 7 with a tear-away opening strip partially removed;

FIG. 9 shows a perspective view of the container of FIG. 8 in an opened configuration;

FIG. 10 shows a perspective view of the opened container of FIG. 9 in a partially refolded configuration for return shipping;

FIG. 11 shows a perspective view of the container of FIG. 10 in a fully refolded, sealed configuration for return shipping;

DETAILED DESCRIPTION

The present disclosure pertains to a shoebox that is configured to be ready for shipping, also termed a "Ship in Own Container" (SIOC) package. The SIOC package has application in ecommerce sales, but may also be used to package items sold through in-person transactions. The SIOC package can be re-sealable after opening to allow for return shipping. Additionally, SIOC packages can be sized and tailored to match the shoes (or other items) contained therein. Such size tailoring can also help reduce the size of the SIOC package for shipping, which can allow for better utilization of storage space within the fulfilment center. SIOC packages can eliminate the need for a shoebox to be placed in a larger outerbox prior to shipping from the fulfilment center. SIOC packages for shoes can also provide branding opportunities for the manufacturer and/or retailer. For example, SIOC packages can include a colorful internal liner that is designed to present the shoes in a new, vibrant manner to the customer upon opening the package. The SIOC package can also contain branding materials, such as logos, slogans, patterns, designs, and formatted instructions on either or both of the liner and the outer surface. The SIOC package can also be convertible into a shoe stand for holding and/or displaying shoes.

Figure 1:
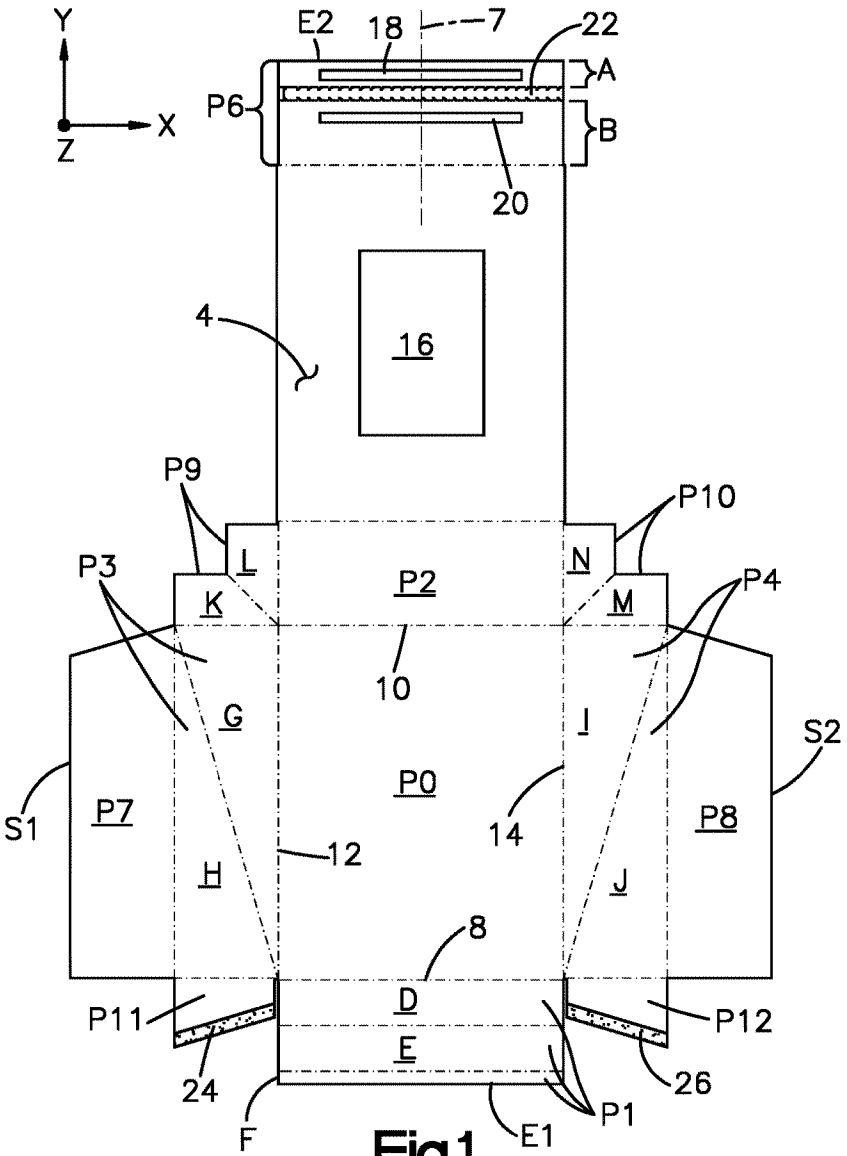
FIG. 1 shows a plan view of a first side of a container in an initial, open configuration, according to one embodiment, wherein distinct panels of the container are identified.
Figure 13:
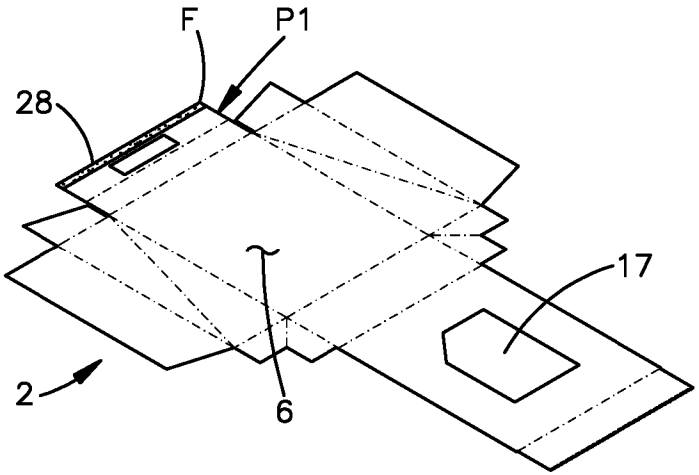
FIG. 13 shows a perspective view of an underside of the opened, unfolded container of FIG. 12.

Referring to FIG. 1, a container 2 is shown according to an embodiment of the present disclosure. The container 2 can be configured to be folded into a single-piece SIOC shoe box. The container 2 is shown in an initial, unfolded configuration, in which it is substantially in a single plane and in its die cut configuration. A first surface 4 of the unfolded container 2 is visible. A second, reverse surface 6 of the container is shown in FIG. 13. With continued reference to FIG. 1, the container 2 can be formed of a material, such as paperboard, cardboard (such as corrugated fiberboard, also referred to as "corrugated board"), other paper-based board materials, or a plastic, by way of non-limiting example. The container 2 can be a single preformed piece of material that is substantially flat or planar when in the unfolded configuration. The container 2 can extend between first and second lateral sides S1, S2 along a first or lateral direction X. The container 2 can also extend between first and second longitudinal ends E1, E2 along a second or longitudinal direction Y that is substantially perpendicular to the first direction X. The container 2 preferably is symmetrical about a center axis 7 oriented along the longitudinal direction Y, although other configurations are within the scope of the present disclosure. The container 2 also has a thickness along a third or vertical direction Z that is substantially perpendicular to the lateral and longitudinal directions X, Y.

The container 2 preferably defines a plurality of joined panels P that are each at least partially bounded by crease lines C that are pre-formed in the container 2. The panels P are foldable relative to one another about the crease lines C so as to configure the container 2 into a shoe box (that is, a cuboid container that is suitable for housing a conventionally sized pair of adult or child shoes or boots) that is ready for shipping. The panels P can include a center panel P0 having a first side 8 and a second side 10 opposite each other along the longitudinal direction Y. The center panel P0 includes a third side 12 and a fourth side 14 opposite each other along the lateral direction X. The container 2 can include a first sidewall panel P1 extending outwardly from the first side 8, a second sidewall panel P2 extending outwardly from the second side 10, a third sidewall panel P2 extending outwardly from the third side 12, and a fourth sidewall panel P4 extending outwardly from the fourth side 14 of the center panel P0.

A first fold-over panel P5 can extend from the second sidewall panel P2 along the longitudinal direction Y toward the second end E2. In the configuration shown, the first fold-over panel P5 includes printed material 16, such as a sticker for a return-shipping label or folding instructions for reconfiguration the container 2 into a shoe stand, as set forth in more detail below, or other indicia relating to the container or its contents. A closure panel P6 can extend from the first fold-over panel P5 along the longitudinal direction Y toward the second end E2. The closure panel P6 can include one or more fasteners, such as a first adhesive strip 18 and a second adhesive strip 20 each elongated along the lateral direction X and spaced from each other along the longitudinal direction Y, by way of non-limiting example. The closure panel P6 can also define an opening feature, such as a perforated tear-away opening strip 22 extending along the lateral direction X, by way of non-limiting example. The depicted fastening adhesive strips 18, 20 and tear-away opening strip 22 configuration is tamper evident, which is preferable for ecommerce transactions. Other types of tamper-evident fasteners are also within the scope of the present disclosure, such as a manufactured tape seal, by way of non-limiting example. Additionally, other types of fastener/opening feature configurations, such as re-usable fasteners, are within the scope of the present disclosure. For example, in other embodiments, such as for in-person transactions, the closure panel P6 can include a tuck tab that is insertable within a slot defined by the first sidewall panel P1, by way of non-limiting example. Thus, the container 2 can optionally be configured for repeated, non-destructive opening and closing, which is preferable for in-person transactions. With continued reference to FIG. 1, the opening strip 22 can separate the closure panel P6 into a first and second portions A, B located on opposite sides of the strip 22 with respect to the longitudinal direction Y. The first adhesive strip 18 can be located on the first portion A, and an edge of the first portion A can define the second end E2 of the container. The second adhesive strip 20 can be located on the second portion B, which is positioned between the first portion A and the first fold-over panel P5 along the longitudinal direction Y. The first adhesive strip 18 can be activated for initial shipping and the second adhesive strip 20 can be activated for return shipping, as set forth in more detail below.

The container 2 can include a second fold-over panel P7 extending from the third sidewall panel P3 along the lateral direction X such that an edge of the second fold-over panel P7 can define the first lateral side S1 of the container 2 in the unfolded configuration. A third fold-over panel P8 can extend from the fourth sidewall panel P4 along the lateral direction X such that an edge of the third fold-over panel P8 can define the second lateral side S2 of the container 2 in the unfolded configuration. In this regard, panels P7 and P8 define the outboard-most portions that define the lateral extent of container 2.

A first corner panel P9 can occupy a corner between the second sidewall panel P2 and the third sidewall panel P3. In this regard, panel P9 shares and edge with both panel P2 and panel P3. A second corner panel P10 can occupy a corner between the second sidewall panel P2 and the fourth sidewall panel P4 such that panel P10 is a mirror image of panel P9, and thus shares an edge with panels P2 and P4. A first tab P11 extends from the third sidewall panel P3 along the longitudinal direction Y toward the first end E1 of the container 2. The first tab P11 can carry a third adhesive strip 24, for example, at a free end thereof. A second tab P12 can extend from the fourth sidewall panel P4 along the longitudinal direction Y toward the first end E1 of the container 2. The second tab P12 can carry a fourth adhesive strip 26, for example, at a free end thereof. As used herein, the phrase "extends" refers to a common edge connection. Thus, neither panel P11 nor P12 extends from the lateral sides of panel P1, as there is a slit of disconnection therebetween.

Figure 2:
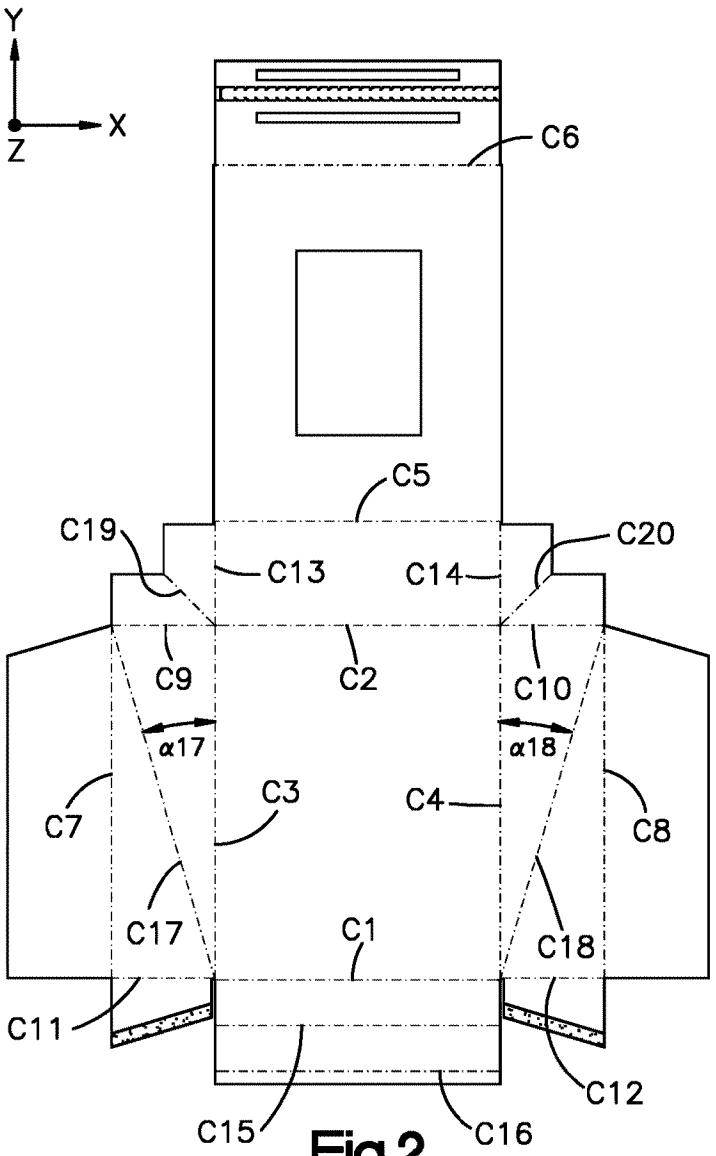
FIG. 2 the plan view of FIG. 1, wherein pre-formed crease lines are identified.

Referring now to FIG. 2, the location and orientation of the crease lines C will now be described (with features of the panels labeled in FIG. 1). A first crease line C1 can extend along the first side 8 of the center panel P0. The first crease line C1 can define a common border between the center panel P0 and the first sidewall panel P1. A second crease line C2 can extend along the second side 10 of the center panel P0. The second crease line C2 can define a common border between the center panel P0 and the second sidewall panel P2. A third crease line C3 can extend along the third side 12 of the center panel P0. The third crease line C2 can define a common border between the center panel P0 and the third sidewall panel P2. A fourth crease line C4 can extend along the fourth side 14 of the center panel P0. The fourth crease line C4 can define a common border between the center panel P0 and the fourth sidewall panel P4.

A fifth crease line C5 can define a common border between the second sidewall panel P2 and the first fold-over panel P5. A sixth crease line C6 can define a common border between the first fold-over panel P5 and the second portion B of the closure panel P6. A seventh crease line C7 can define a common border between the third sidewall panel P3 and the second fold-over panel P7. An eighth crease line C8 can define a common border between the fourth sidewall panel P4 and the third fold-over panel P8. A ninth crease line C9 can define a common border between the third sidewall panel P3 and the first corner panel P9. A tenth crease line C10 can define a common border between the fourth sidewall panel P4 and the second corner panel P10. An eleventh crease line C11 can define a common border between the third sidewall panel P3 and the first tab P11. A twelfth crease line C12 can define a common border between the fourth sidewall panel P4 and the second tab P12. A thirteenth crease line C13 can define a common border between the fourth sidewall panel P4 and the first corner panel P9. A fourteenth crease line C14 can define a common border between the fourth sidewall panel P4 and the second corner panel P10.

Some of the panels P set forth above can include two or more portions that are foldable relative to each other about a pre-formed crease line C. For example, the first sidewall panel P1 can include a first portion D extending along the longitudinal direction Y from the first crease line C1 to a fifteenth crease line C15, a second portion E extending along the longitudinal direction Y from the fifteenth crease line C15 to a sixteenth crease line C16, and a third portion F extending along the longitudinal direction Y from the sixteenth crease line C16 to the first end E1 of the container 2. The first, second, fifth, sixth, ninth, tenth, eleventh, twelfth, fifteenth, and sixteenth crease lines C1, C2, C5, C6, C9, C10, C11, C12, C15, C16 can each extend substantially along the lateral direction X, while the third, fourth, seventh, eighth, thirteenth and fourteenth crease lines C3, C4, C7, C8, C13, C14 can each extend substantially along the longitudinal direction Y.

The third sidewall panel P3 can include a first portion G and a second portion H that share a common border along a seventeenth crease line C17. Similarly, the fourth panel sidewall can include a first portion I and a second portion J that a share a common border along an eighteenth crease line C18. The first corner panel 9 can include a first portion K and a second portion L that share a common border along a nineteenth crease line C19. The second corner panel 10 can include a first portion M and a second portion N that share a common border along a twentieth crease line C20. The seventeenth, eighteenth, nineteenth and twentieth crease lines C17, C18, C19, C20 can each be oriented at an acute angle with respect to a lines extending along the lateral and longitudinal directions X, Y. For example, the seventeenth and eighteenth crease lines C17, C18 can each be oriented at an angle α17, α18 in the range of about 10 degrees and about 60 degrees relative to the third and fourth crease lines C3, C4, respectively, such as between about 25 degrees and about 45 degrees, by way of non-limiting example. It is to be appreciated, however, that in other embodiments, the angles α17, α18 can be less than 10 degrees and greater than 60 degrees, such as approximately as small as 5 degrees and as large as 80 degrees, according to the desired display angle, as explained more fully below.

Referring now to FIGS. 3 through 7, the container 2 can be folded into a fully enclosed, sealed SIOC shoe box (FIG. 7) that is ready for shipping with the first surface 4 forming the interior of the box.

Figure 3:
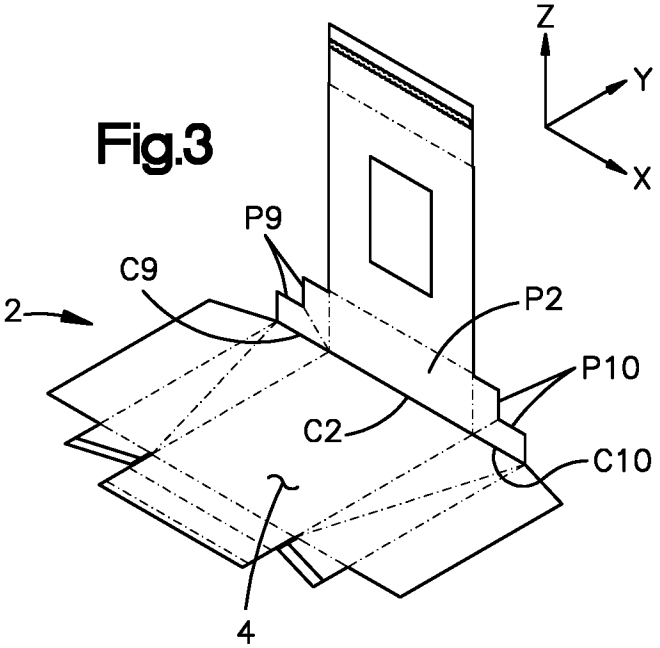
FIG. 3 shows a perspective view of the container of FIG. 1, wherein the container is folded to a first partially folded configuration.

As shown in FIG. 3, the second sidewall panel P2 and the corner panels P9, P10 can be folded upwards about crease lines C2, C9, and C10. In this manner, the second sidewall panel P2 forms a sidewall of the container 2.

Figure 4:
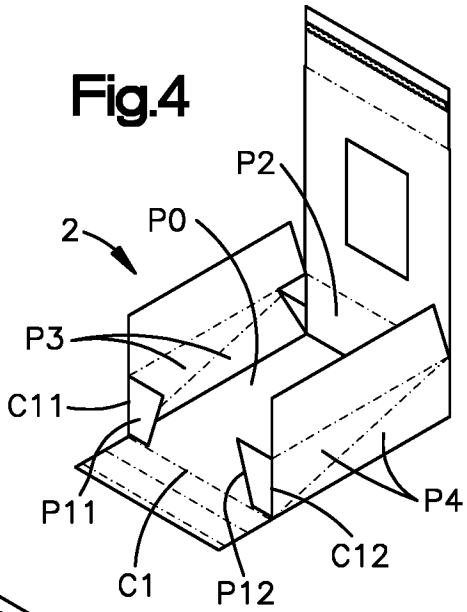
FIG. 4 shows a perspective view of the container of FIG. 1, wherein the container is folded to a second partially folded configuration.

As shown in FIG. 4, the third and fourth sidewall panels P3, P4 can be folded upwards with respect to crease lines C3 and C4, respectively. In this manner, the third and fourth sidewall panels P3, P4 form two more sidewalls (adjacent the sidewall formed by panel P2) of the container 2. Folding of the third and fourth sidewall panels P3, P4 can be assisted by collapsing the corner panels P9 and P10 inward about respective crease lines C19, C20 so that the first portions K, M and respective second portions L, N of the corner panels P9, P10 fold against one another. The tabs P11, P12 can also be folded inward about crease lines C11, C12 so as to extend substantially along the first crease line C1 at a periphery of the center panel P0.

Figure 5:
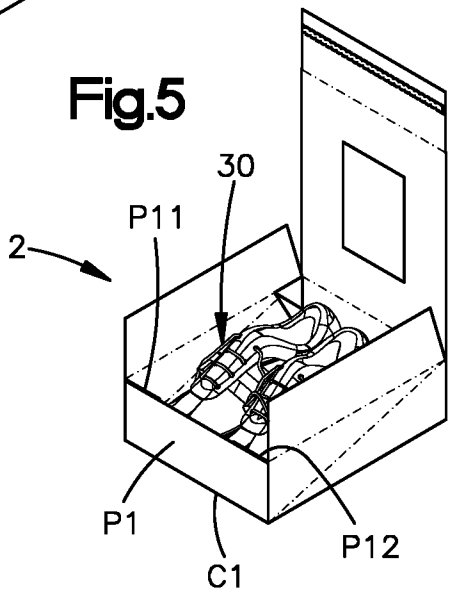
FIG. 5 shows a perspective view of the container of FIG. 1, wherein the container is folded to a third partially folded configuration.

As shown in FIG. 5, the first sidewall panel P1 can be folded upwards about crease line C1 so as to abut the tabs P11, P12 and form the final sidewall of the container 2. A product, such as a pair of shoes 30, can be placed in the container 2 on the center panel P0.

Figure 6:
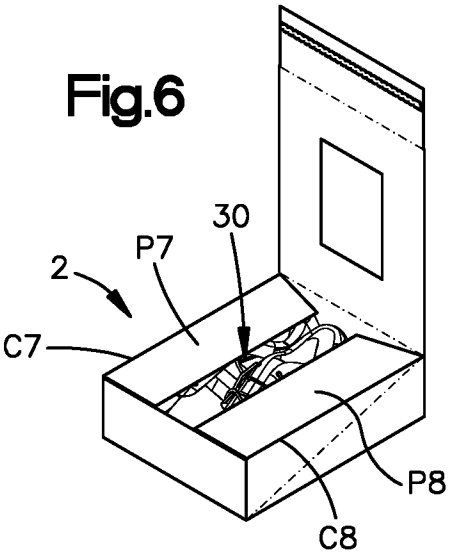
FIG. 6 shows a perspective view of the container of FIG. 1, wherein the container is folded to a fourth partially folded configuration.

As shown in FIG. 6, the second and third fold-over panels P7, P8 can be folded inward and downward about crease lines C7, C8 so as to overlay the center panel P0 and at least partially cover the shoes 30.

As shown in FIG. 7, the first fold-over panel P5 can be folded downward about crease line C5 to as to overly the shoes 30 and the center panel P0 and to form a top of the container 2, which can carry a shipping label 17 on the second surface 6 thereof. Additionally, the first adhesive strip 18 can be activated (such as be removing a protective backing strip therefrom) and the closure panel P6 can be folded downward so as to seal to the first sidewall panel P1 via the first adhesive strip 18. In this manner, the container 2 can be sealed in an enclosed configuration with the shoes 30 inside, ready for induction into the fulfillment center, and in some circumstances, for application a shipping label and ultimately for shipping to a customer without another exterior container.

As shown in FIGS. 8 and 9, upon receiving the container 2, a customer can open the container 2 by removing the tear-away opening strip 22, which detaches the second portion B of the closure panel P6 from the first portion A that remains sealed to the first sidewall panel P1. The first fold-over panel P5 can then be lifted and the container 2 opened. For return shipping, as shown in FIG. 10, the return shipping label sticker 16 can be removed from the first (interior) surface 4 of the fold-over panel P5 and placed over the shipping label 17 (see FIG. 7) on the second (exterior) surface 6 thereof. Additionally, the second adhesive strip 20 on the second portion B of the closure panel P6 can be activated, such as by removing a backing 31 therefrom (in a peel-and-stick way), to seal the second portion B of the closure panel P6 to the first sidewall panel P1 (FIG. 11).

Figure 12:
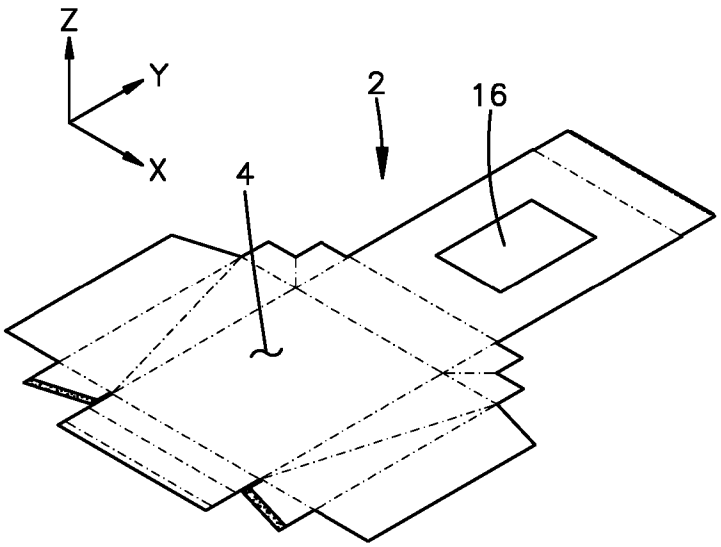
FIG. 12 shows a perspective view of the opened container of FIG. 9 in a fully unfolded configuration.
Figure 18:
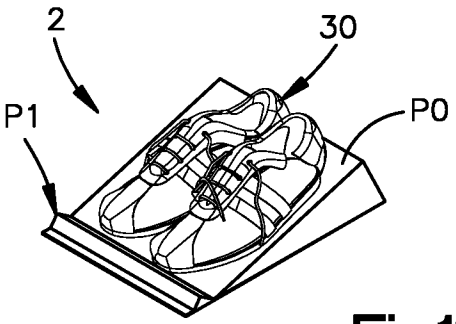
FIG. 18 shows a perspective view of the fully converted container of FIG. 18 displaying a pair of shoes thereon.

Referring now to FIGS. 12 through 18, the container 2 is configured to be converted into a display stand for the item originally shipped in the container 2, such as shoes, by way of non-limiting example. Thus, the container 2 can be reconfigured from a SIOC shoe box, such as shown in FIG. 7, into a shoe stand or display configuration for supporting and/or displaying the shoes 30 (FIG. 18). As shown in FIG. 12, with the tear-away opening strip 22 removed, the container 2 can be unfolded into a substantially flat configuration similar to that shown in FIGS. 1 and 2. As shown in the upward-looking perspective view of FIG. 13, on the reverse surface 6 of the container 2, the third portion F of the first sidewall panel P1 can carry a fifth adhesive strip 28.

Figure 14:
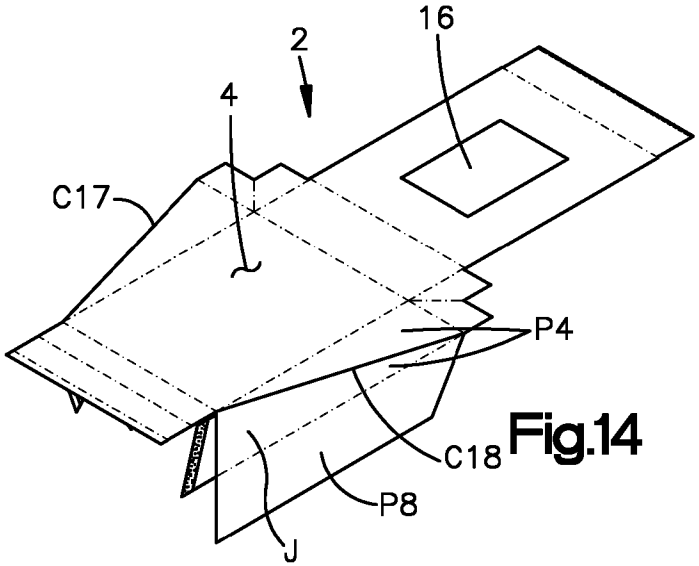
FIG. 14 shows a perspective view of the container of FIG. 12 in a first partially converted configuration.
Figure 15:
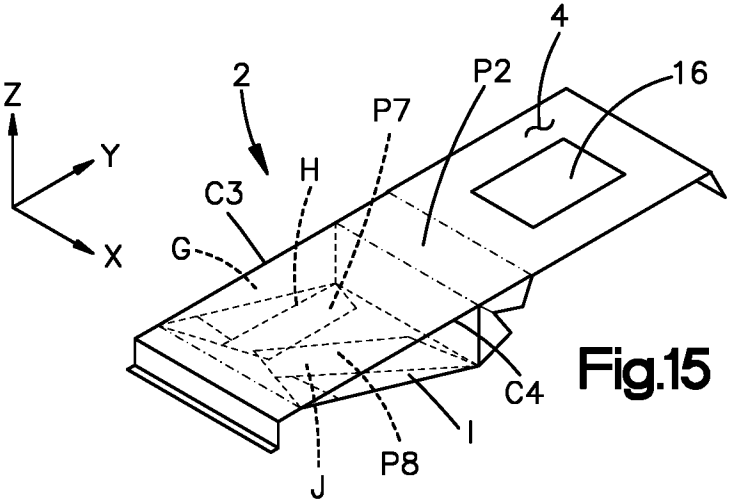
FIG. 15 shows a partially transparent perspective view of the container of FIG. 12 in a second partially converted configuration.

With reference to FIG. 14, the container 2 can be folded into a first partially converted configuration by folding the second portion H of the third sidewall panel P3 (not visible in FIG. 14) downward about crease line C17 and by folding the second portion J of the fourth sidewall panel P4 downward about crease line C18. The second and third fold-over panels P7, P8 can also be maintained or otherwise made coplanar with the respective second portions H, J of the third and fourth sidewall panels P3, P4. Referring now to FIG. 15, the first portion G of the third sidewall panel P3 and the first portion I of the fourth sidewall panel P4 can be folded downward 90 degrees about respective crease lines C3 and C4 so that portions G and I are parallel and spaced from each other along the lateral direction X. The second portions H, J of the third and fourth sidewall panels P3, P4 and the second and third fold-over panels P7, P8 can each be oriented substantially perpendicular to portions G and I about crease lines C17 and C18. The second portion E of the first sidewall panel P1 can be folded downward about crease line C15 and the third portion F of the first sidewall panel P1 can be folded back upward about crease line C16.

Figure 16:
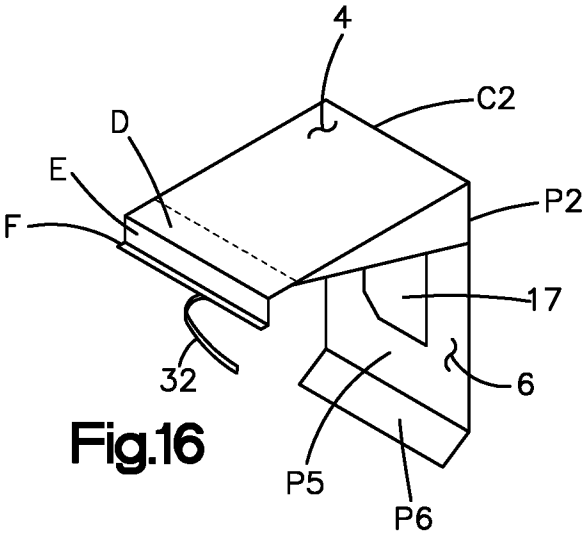
FIG. 16 shows a perspective view of the container of FIG. 12 in a third partially converted configuration.
Figure 17:
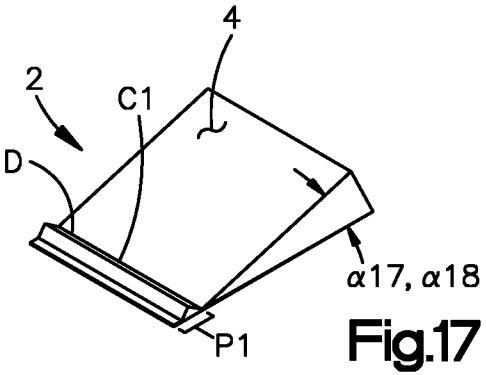
FIG. 17 shows a perspective view of the container of FIG. 12 in a fully converted configuration.

Referring now to FIG. 16, the second sidewall panel P2 can be folded in a range of about 45 degrees to about 90 degrees downward about crease line C2, so as to form a rear of the shoe stand configuration of the container 2. The fifth adhesive strip 28 on the reverse surface 6 (FIG. 13) of the third portion F of the first sidewall panel P1 can be activated, such as by removing a backing strip 32 therefrom. Referring now to FIG. 17, the first portion D of the first sidewall panel P1 can be folded upwards about crease line C1 so that the panel P1 is shaped as a laterally elongated wedge, and the first fold-over panel P5 can be folded forward in a range of about 90 degrees and about 150 degrees about crease line C5 so as to form a bottom of the shoe stand. The fifth adhesive strip 28 can adhere to the reverse surface 6 of closure panel P6 in a manner maintaining the container 2 in the shoe stand configuration. Thus, the container 2 can be fully converted into a shoe stand using the folds as described. The center panel P0 can be inclined at an angle that is substantially defined by angles α17, α18. As shown in FIG. 18, the converted container 2 can support a pair of shoes 30 on the center panel P0, and the wedge-shaped panel P1 can form a lip for retaining the shoes 30 on the center panel P0. It is to be appreciated that, alternatively, the fifth adhesive strip 28 can be carried by the second surface 6 of the closure panel P6 and can be configured to adhere to the second surface 6 of the first sidewall panel P1. Moreover, in other embodiments, the first sidewall panel P1 can be configured such that the second and third portions E, F con be folded so as to be inclined in a manner forming a lip while the first portion D is parallel with the closure panel P6. Furthermore, alternative fastening features can be employed for connecting the closure panel P6 to the first sidewall panel P1 in the shoe stand configuration, such as a tuck tab and corresponding slot, a pressure activated fastener or adhesive, or the customer can even tape the panels P6, P1 together, by way of non-limiting example.

It is to be appreciated that the container 2 is configured such that the first and second surfaces 4, 6 of the single piece of material are reversible between the SIOC shoe box configuration and the shoe stand configuration. In this manner, the second surface 6, which, in the SIOC shoe box configuration, is the exterior surface of the container 2, becomes the interior surface of the shoe stand. This is beneficial because, in ecommerce transactions, the exterior surface of the SIOC shoe box carries the shipping label 17 and is often unsightly and becomes scuffed, dirty, or otherwise degraded in appearance during shipping. However, in the embodiments disclosed herein, the exterior surfaces of the shoe box become internal (and thus hidden) surfaces when the container 2 is in the shoe stand configuration. Even in embodiments where the first surface 4 of the fold-over panel P5 includes printed material 16, such as folding instructions, the printed material 16 becomes located on the underside of the fully converted shoe stand and is thus out of view during use. It is also to be appreciated that the folding sequences set forth above represent non-limiting examples of methods for converting the container 2 from a SIOC shoe box configuration to a shoe stand configuration. It is also to be appreciated that the container 2 design and crease lines C set forth herein represent one example of a reconfigurable container.

It should be noted that the illustrations and descriptions of the embodiments shown in the figures are for exemplary purposes only, and should not be construed limiting the disclosure. One skilled in the art will appreciate that the present disclosure contemplates various embodiments. Additionally, it should be understood that the concepts described above with the above-described embodiments may be employed alone or in combination with any of the other embodiments described above. It should further be appreciated that the various alternative embodiments described above with respect to one illustrated embodiment can apply to all embodiments as described herein, unless otherwise indicated.

Unless explicitly stated otherwise, each numerical value and range should be interpreted as being approximate as if the word "about" or "approximately" preceded the value or range.

It should be understood that the steps of exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

What is claimed is:

1. A single piece of material defining a plurality of pre-formed crease lines, comprising:

a central panel;

a first sidewall panel extending from a first side of the central panel;

a second sidewall panel extending from a second side of the central panel opposite the first side along a first direction;

a fold-over panel extending from the second sidewall panel;

a third sidewall panel extending from a third side of the central panel; and a fourth sidewall panel extending from a fourth side of the central panel opposite the third side along a second direction substantially perpendicular to the first direction, wherein each of the third and fourth sidewall panels defines a first portion and a second portion adjoined at a common crease line that is oriented at an acute angle relative to the respective third or fourth side of the central panel;

wherein the panels are foldable relative to one another about respective ones of the pre-formed crease lines from a first folded configuration to a second folded configuration such that, in the first folded configuration, each of the sidewall panels extends upward from the central panel along a third direction that is substantially perpendicular to the first and second directions and, in the second folded configuration:

the second sidewall panel and the respective first portions of the third and fourth sidewall panels each extend downward from the central panel along the third direction, the second portions of the third and fourth sidewall panels are folded inwardly about the respective common crease lines so that each underlies the central panel, and the fold-over panel extends from the second sidewall panel underneath the central panel at least to the first side of the central panel and along the common crease lines so that the central panel is inclined at the acute angle with respect to the fold-over panel.

2. The single piece of material of claim 1, wherein the single piece of material is pre-formed in a substantially flat die-cut configuration.

3. The single piece of material of claim 2, wherein, in the substantially flat die-cut configuration:

each of the panels defines a first surface and a second surface opposite the first surface along the third direction, the first surfaces are all co-planar, and the second surfaces are all co-planar.

4. The single piece of material of claim 3, wherein:

in the first folded configuration, the single piece of material is in a shape of a cuboid, and each of the first surfaces defines an internal surface of the cuboid, and in the second folded configuration, the first surfaces of at least the central panel, the second sidewall panel, and the fold-over panel define exterior surfaces, and the single piece of material is substantially wedge-shaped.

5. The single piece of material of claim 1, wherein the first sidewall panel defines a first additional crease line and a second additional crease line.

6. The single piece of material of claim 5, wherein the first sidewall panel further defines a first portion extending from the first crease line to the first additional crease line and a second portion extending from the first additional crease line to the second additional crease line.

7. The single piece of material of claim 1, wherein the acute angle is in the range of about 25 degrees to about 35 degrees.

8. A single piece of material defining a plurality of pre-formed crease lines, comprising:

a central panel;

first and second sidewall panels extending respectively from opposite first and second sides of the central panel along a first direction;

a fold-over panel extending from the second sidewall panel;

third and fourth sidewall panels extending respectively from opposite third and fourth sides of the central panel along a second direction substantially perpendicular to the first direction, wherein each of the third and fourth sidewall panels defines a first portion and a second portion adjoined at a common crease line that is oriented at an acute angle relative to the respective third or fourth side of the central panel, wherein the panels are foldable relative to one another about respective ones of the pre-formed crease lines from a first folded configuration to a second folded configuration, such that:

in the first folded configuration, each of the sidewall panels extends upward from the central panel along a third direction that is substantially perpendicular to the first and second directions, and in the second folded configuration:

the second sidewall panel and the respective first portions of the third and fourth sidewall panels each extend downward from the central panel along the third direction;

the second portions of the third and fourth sidewall panels are folded inwardly about the respective common crease lines so that that each underlies the central panel, and the fold-panel extends from the second sidewall panel underneath the central panel and along the common crease lines so that the central panel is inclined at the acute angle with respect to the fold-over panel, wherein the first sidewall panel defines a first crease line along the first side of the central panel, a first additional crease line, a second additional crease line, a first portion extending from the first crease line to the first additional crease line, and a second portion extending from the first additional crease line to the second additional crease line, wherein the first crease line, the first additional crease line, and the second additional crease line are each parallel, and, when the single piece of material is in the second folded configuration, the first and second portions of the first sidewall panel are each inclined so as to form a lip elongated along the first crease line, and the first additional crease line is at an apex of the lip.

9. The single piece of material of claim 8, wherein the first sidewall panel defines a third portion extending from the second additional crease line away from the second portion of the first sidewall panel, and the third portion carries a fastener configured to fasten the third portion to the fold-over panel when the single piece of material is in the second folded configuration in a manner maintaining the lip.

10. A single piece of material pre-formed in a substantially flat die-cut configuration and defining a plurality of pre-formed crease lines, comprising:

a central panel;

a first sidewall panel extending from a first side of the central panel;

a second sidewall panel extending from a second side of the central panel opposite the first side along a first direction;

a fold-over panel extending from the second sidewall panel;

a third sidewall panel extending from a third side of the central panel; and a fourth sidewall panel extending from a forth side of the central panel opposite the third side along a second direction substantially perpendicular to the first direction, wherein each of the third and fourth sidewall panels defines a first portion and a second portion adjoined at a common crease line that is oriented at an acute angle relative to the respective third or forth side of the central panel; and a closure panel, wherein, in the substantially flat die-cot configuration, each of the panels defines a first surface and a second surface opposite the first surface along a third direction that is substantially perpendicular to the first and second directions, the first surfaces all being co-planar, and the second surfaces all being co-planar, wherein the panels are foldable relative to one another about respective ones of the pre-formed crease lines, from a first folded configuration to a second folded configuration, such that:

in the first folded configuration, each of the sidewall panels extends upward from the central panel along the third direction such that the single piece of material is in a shape of a cuboid, in which the first surface of the closure panel abuts the second surface of the first sidewall panel and each of the remaining first surfaces defines an internal surface of the cuboid, and in the second folded configuration:

the second sidewall panel and the respective first portions of the third and fourth sidewall panels each extend downward from the central panel along the third direction, the second portions of the third and fourth sidewall panels are folded inwardly about the respective common crease lines so that each underlies the central panel, the fold-over panel extends from the second sidewall panel underneath the central panel and along the common crease lines so that the central panel is inclined at the acute angle with respect to the fold-over panel, the first surfaces of at least the central panel, the second sidewall panel, and the fold-over panel define exterior surfaces, the single piece of material is substantially wedge-shaped, and the second surface of the closure panel abuts the second surface of the first sidewall panel.

11. The single piece of material of claim 10, wherein the second surface of the first sidewall panel carries a fastener and, in the second folded configuration, the fastener is configured to fasten the second surface of the closure panel to the second surface of the first sidewall panel.

12. The single piece of material of claim 11, wherein the closure panel comprises a first portion and a second portion separated by a perforated tear-away strip, the first surface of the first portion of the closure panel carrying a second fastener configured to attach to the second surface of the first sidewall panel when the single piece of material is in the first folded configuration.

13. The single piece of material of claim 12, wherein the fastener is configured to fasten the second surface of the first sidewall panel to the second surface of the second portion of the closure panel when the single piece of material is in the second folded configuration.

14. The single piece of material of claim 12, wherein at least one of the fastener and the second fastener comprises an adhesive strip.

* * * * *